United States Patent [19]

Paolino

[11] 4,412,192

[45] Oct. 25, 1983

[54] MILLIMETER WAVE DIELECTRIC WAVEGUIDE ROTARY JOINT

[75] Inventor: Donald D. Paolino, Ridgecrest, Calif.

[73] Assignee: The United States of America as represented by the Secretary of the Navy, Washington, D.C.

[21] Appl. No.: 292,777

[22] Filed: Aug. 14, 1981

[51] Int. Cl.[3] ..... H01P 1/06

[52] U.S. Cl. ..... 333/257; 333/261

[58] Field of Search ..... 333/240, 256, 257, 261

[56] References Cited

U.S. PATENT DOCUMENTS 3.786,378 1/1974 Liquori ..... 333/257

*Primary Examiner*—Paul L. Gensler

*Attorney, Agent, or Firm*—R. F. Beers; W. Thom Skeer; R. J. Vell

[57] ABSTRACT a dielectric waveguide is used as a connecting medium in a rotary joint transmitting waveguide energy in the 3 mm region. The dielectric waveguide is fastened within a ball bearing race to provide relative motion between the gimballed and stationary waveguide structure. Launch horns are used to enhance transmission through said dielectric waveguide.

16 Claims, 7 Drawing Figures

MILLIMETER WAVE DIELECTRIC WAVEGUIDE ROTARY JOINT

BACKGROUND OF THE INVENTION

1. Field of the Invention

The present invention relates to the transmission of electro-magnetic energy. More particularly the invention relates to the transmission of millimeter waveguided energy in gimballed systems. In still further particularity the invention may be described as a millimeter wave dielectric waveguide joint for use in gimballed electronic applications.

2. Description of the Prior Art

Rotating joints are used in a number of electronics applications, such as missile seeker homing systems, conical scan direction finding systems, scanning radars and in antenna range measurement facilities. During recent years the military has become increasingly interested in millimeter wave systems. The current waveguide rotary joints available for use at millimeter wave frequencies are considered to be deficient in at least three aspects, to-wit:

a. Transmission loss is too high for millimeter-wave frequencies and thus results in performance limitations on the military hardware fielded;

b. Performance degrades appreciably with increases in field use, resulting in severe maintenance problems for fielded systems using these devices;

c. The cost of these devices is extremely high.

Presently known rotary joints use at least two metallic waveguides relatively rotatable to achieve the desired result; these waveguides must be physically separated yet give the electrical appearance of continuity. Most joints contain a choke flange, which requires machining quarterwave length grooves thereinto, to insure good electrical contact between the mechanically split sections. For millimeter wavelength applications this requires very intricate machining of the joint.

Further, unless metallic waveguides are charged with inert gas, their interior surfaces are subject to corrosion which can result in degradation of the transmitted signal.

SUMMARY OF THE INVENTION

The present invention solves the above problems by the use of a dielectric waveguide of such diameter as to transmit frequencies in the 3 mm wavelength region. Said dielectric waveguide is captivated within a launching horn which is press fit into a ball bearing which is press fit into a flange for mating to either an antenna feed horn or a waveguide. The opposite end of said dielectric waveguide is captivated in a second launching horn which is integrated into a flange for connecting the dielectric rotating joint to the remainder of the waveguide system.

OBJECTS OF THE INVENTION

It is an object of this invention to provide a low loss rotary joint for use in millimeter wave electronics applications.

Another object of this invention is to provide an inexpensive rotary joint for millimeter wave applications.

These and other objects and features of the present invention will become apparent from the following description and figures associated therewith.

DESCRIPTION OF THE PREFERRED EMBODIMENT

Most feed horns for conical scan or cassegrain antenna applications use dual mode or scalar type construction. These horn antennae require input excitation to be of the $TE_{11}°$ (Transverse Electric one, one Circular) waveguide mode. It is known that a dielectric waveguide can be inexpensively fabricated which will operate in the $HE_{11}$ (a hybrid field in which both, non zero, longitudinal electric and magnetic fields exist in the direction of propagation, wherein the $TE_{11}$ field predominates in a waveguide cross section) hybrid mode. This mode easily provides a direct launch for the feed horn excitation.

Figure 1:
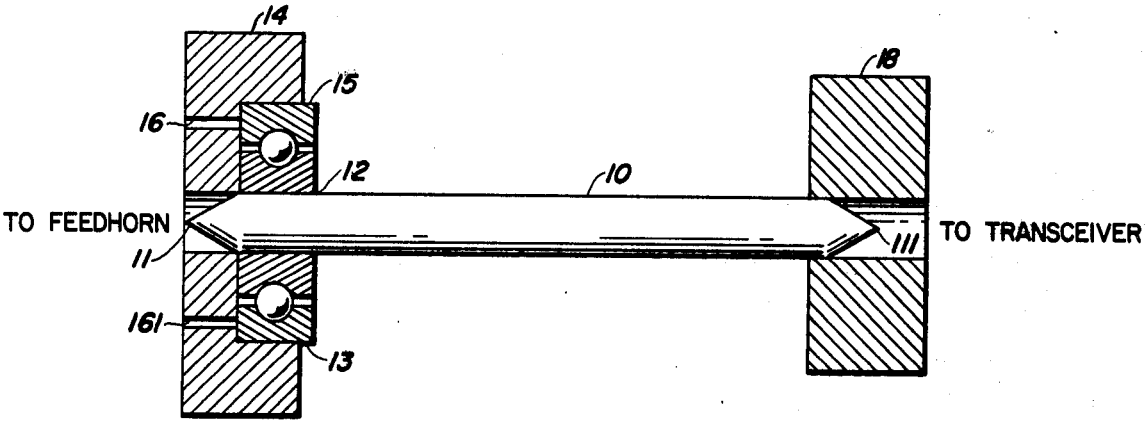
FIG. 1 is a cross sectional view of one embodiment (a first embodiment) of the rotary joint taken along the longitudinal axis.

Referring to FIG. 1, a dielectric waveguide 10 is a dielectric rod of a diameter sufficient to support the $HE_{11}$ waveguide mode in the 3 mm region. Dielectric waveguide 10 is tapered to conical tips 11 and 111 in order to minimize reflections at dielectric waveguide 10 joints.

Dielectric waveguide 10 is press fit or shrunk fit into the inner diameter 12 of ball bearing 13. The depth of insertion of waveguide 10 into ball bearing 13 is critical and must be determined by measurement and observation for the particular frequency used in the particular application. This is conventionally accomplished by minimizing the insertion loss of a wave traveling through dielectric waveguide 10 as measured by a standard microwave network analyzer for the particular frequency under consideration.

Ball bearing 13 is press fit into a first flangehousing 14 which has a recess 15 machined thereinto for receiving ball bearing 13. First flange-housing 14 has two knockout ports 16 and 161 connecting recess 15 with the opposite side of first flange-housing 14. Knockout ports 16 and 161 may be used to remove ball bearing 13 if repairs are necessitated. First flange-housing 14 also has a standard hole pattern, not shown, for attaching it to other microwave components, such as a corrugated waveguide (35 in FIG. 3), a mode converter (not shown), or a feedhorn (22 in FIG. 3). Said standard hole pattern accomodates 4–40 bolts or whatever attachment device is required for system integration.

For integration to the remainder of the transceiver system, dielectric waveguide 10 is press fit directly into a second flange-housing 18 which then attaches to a commercial $TE_{11}°$ to $TE_{10}^{\square}$ (Transverse Electric one, zero Rectangular Waveguide Mode) transition mode converter (not illustrated in the drawings). Alternatively dielectric waveguide 10 may be press fit directly to a commercial $TE_{11}°$ to $TE_{10}$ transition mode converter.

Figure 2A:
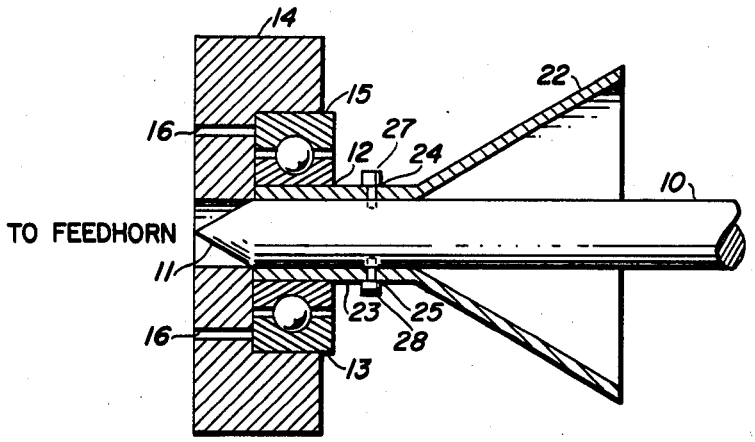
FIG. 2A is a cross sectional view of a second embodiment of the feedhorn end of the rotary joint.
Figure 2B:
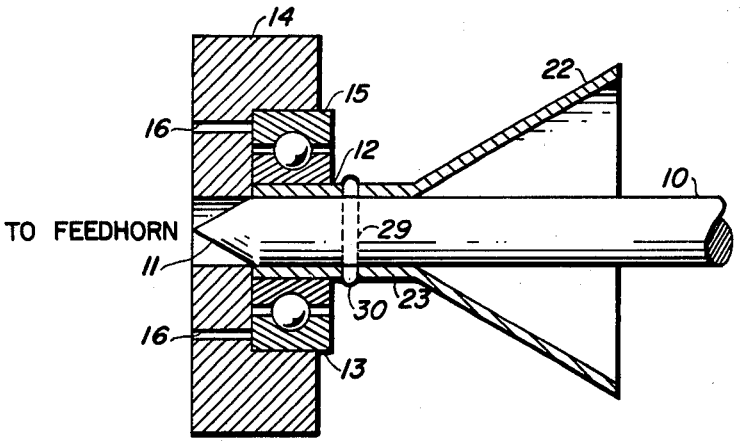
FIG. 2B is a cross sectional view of a third embodiment of the feedhorn end of the rotary joint.

The performance characteristics of the basic rotary joint shown in FIG. 1 can be improved by modifications shown in FIGS. 2A and 2B. The basic components of the rotary joint shown in FIG. 1 are duplicated except that inner diameter 12 of ball bearing 13 has been enlarged to accomodate a tubular extension 23 of a first launching horn 22. Extension 23 must have a sufficiently large inner diameter to accomodate dielectric waveguide 10. As noted previously, the optimum depth of insertion of dielectric waveguide 10 must be determined for each application as described previously.

Extension 23 and first launching horn 22 are made of copper. Extension 23 protrudes a distance from ball bearing 13 before it flares to first launching horn 22. This protrusion allows space for the captivation of dielectric waveguide 10. Two methods of captivation have been used with very little loss occuring as a result of either of them.

In FIG. 2A, a very small diameter drill was used to penetrate extension 23 forming apertures 24 and 25. Dielectric waveguide 10 was penetrated to a depth of up to 1/32". Epoxy plugs 27 and 28 were inserted and bonded to both dielectric waveguide 10 and extension 23.

In FIG. 2B, dielectric waveguide 10 has been drilled through and a machined dielectric stud 29 inserted through apertures 24 and 25 and dielectric waveguide 10. Stud 29 has been bonded to the outside of extension 23 with epoxy 30. The captivation techniques shown in FIGS. 2A and 2B are useful where the joint may be subjected to temperature variations which might cause a separation of dielectric waveguide 10 from extension 23.

First launching horn 22 is employed to more efficiently launch the $HE_{11}$ mode of dielectric waveguide 10 from the $TE_{11}°$ mode (i.e. the incident/exciting mode at conical tip 11). First launching horn 22 is constructed of copper and flares at an optimum angle (between 30°-45°, as illustrated in the drawings) for the particular frequency transmitted.

Figure 4A:
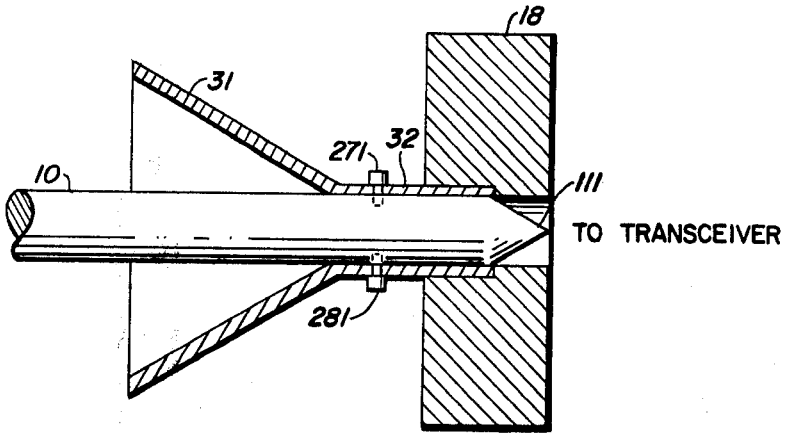
FIG. 4A is a cross-sectional view of the transceiving end of FIG. 2A.
Figure 4B:
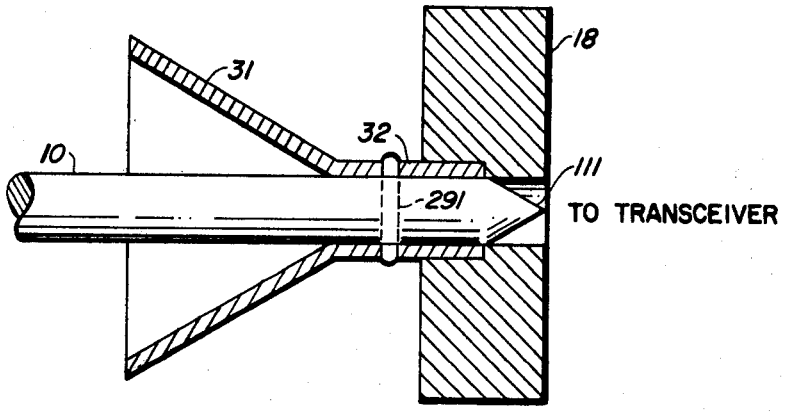
FIG. 4B is a cross-sectional view of the transceiving end of FIG. 2B.

In FIGS. 4A and 4B, a second launching horn 31 is affixed about dielectric waveguide 10 in the same manner as first launching horn 22. Tubular extension 32 of second launching horn 31 connects second launching horn 31 to second flange housing 18. Captivation of dielectric waveguide 10 within extension 32 is identical to captivation in extension 23 comprising epoxy plugs 271 and 281 in FIG. 4A, and dielectric stud 291 in FIG. 4B. Second launching horn 31, extension 32, and second flange housing 18 may be machined as one part, or second flange housing 18 may receive extension 32 within its axial aperture.

Figure 3:
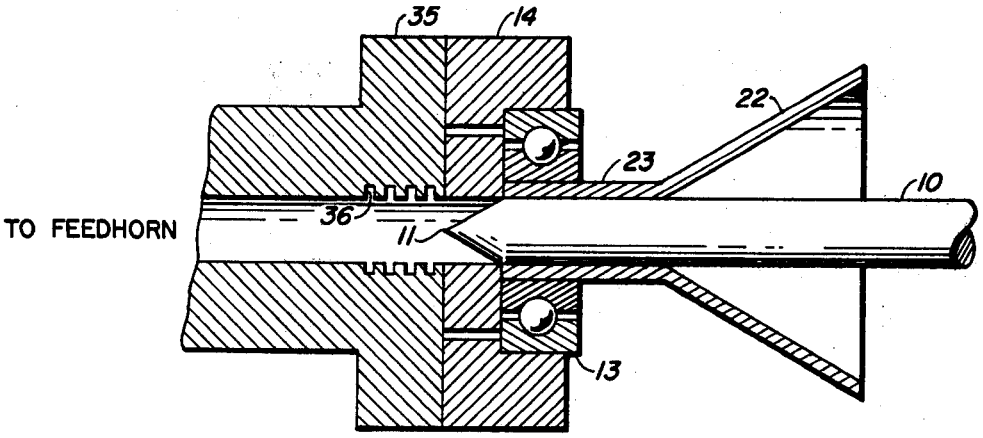
FIG. 3 is a cross sectional view of a fourth embodiment of the rotary joint.
Figure 5:
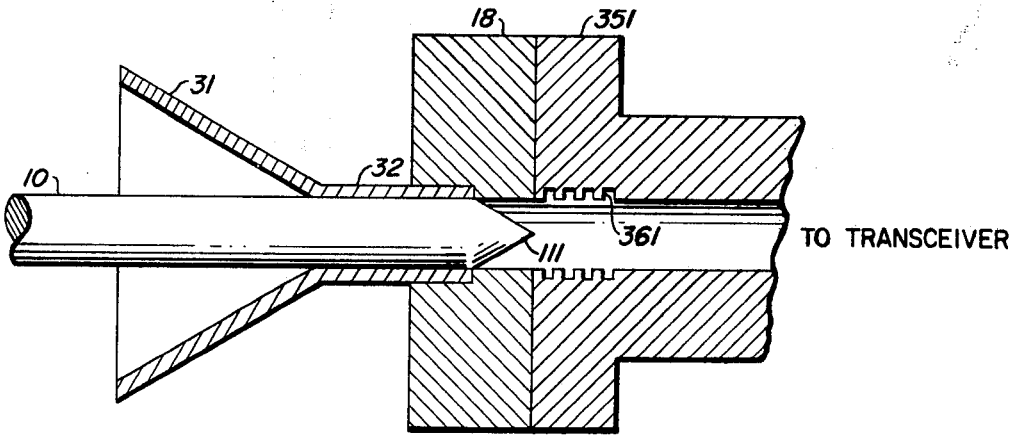
FIG. 5 is a cross-sectional view of the transceiving end of FIG. 3.

A further modification of the device is shown in FIG. 3. Since dielectric waveguide 10 operates in the $HE_{11}$ hybrid mode, launch into said mode from the $TE_{11}°$ mode should be facilitated by corrugated circular waveguides 35 and 351 proximal to each end of dielectric waveguide 10, as illustrated in FIGS. 3 and 5. The corrugations 36 and 361 should induce a hybrid mode which should provide a better launch for the $HE_{11}$ mode. Corrugated waveguides are standard, well known, devices in the art as clearly delineated in an article by Knop and Wiesenfarth, "On the radiation from an open ended corrugated pipe carrying the $HE_{11}$ mode." IEEE TRANS AP, Vol. AP 20. Sept. 1, 1972, pp. 644–648. Corrugations 36 and 361 may be integrated into the inner diameter of first and second housings 14 and 18 thereby eliminating the need for corrugated circular waveguides 35 and 351.

In as much as the description in figures contained herein depiet a simple yet effective design it is to be understood that said description and figures are for illustrative purposes and are not intended to limit the scope and principles of the invention, which will encompass numerous modifications and adaptations which will suggest themselves to those familiar with the art, and which are defined by the claims appended hereto.

I claim:

1. An apparatus for use as a waveguide rotary joint in a waveguide system, comprising:

a ball bearing having an inner and an outer race, whose inner race diameter will support the $TE_{11}°$ waveguide mode at a predetermined wavelength;

a flexible dielectric waveguide having the same diameter as said ball bearing's inner face, and having first and second ends, said first end of said dielectric waveguide operably attached to said ball bearing inner race;

means for attaching said ball bearing to said waveguide system;

means for attaching said second end of said dielectric waveguide to said waveguide system.

2. An apparatus according to claim 1 wherein said ball bearing has an inside diameter which will support the $TE_{11}°$ waveguide mode in the millimeter wavelength.

3. An apparatus according to claim 1 wherein said ball bearing has an inside diameter which will support the $TE_{11}°$ waveguide mode in the 3 mm region of the electromagnetic spectrum.

4. An apparatus according to claim 1 wherein said dielectric waveguide is press or shrunk fit into said ball bearing's inner race.

5. An apparatus according to claim 4 wherein said dielectric waveguide protrudes into the inner race of said ball bearing, said protrusion having a conically tapered shape.

6. An apparatus according to claim 1 wherein said attaching means is a first flange housing having apertures therein for receiving fasteners to affix said flange housing to said waveguide.

7. An apparatus according to claim 6 wherein said flange housing has a recess such that the outer diameter of said ball bearing can be press fit thereinto.

8. An apparatus according to claim 7 wherein said flange housing has apertures to accomodate the removal of said ball bearing.

9. An apparatus according to claim 8 further comprising a first launching horn for improving the interface between said dielectric waveguide and said waveguide system operably connected about said dielectric waveguide.

10. An apparatus according to claim 9 wherein said first launching horn comprises:

a hollow copper cone flared concentrically about said dielectric waveguide at an angle conducive to the transmission of electromagnetic energy along said dielectric waveguide, having a minimum tapered diameter equal to the diameter of said dielectric waveguide; and a tubular extension of said copper cone having an inner diameter equal to the diameter of said dielectric waveguide for fixedly receiving and captivating said dielectric waveguide therein, said tubular extension having an outer diameter such that it may be press fit within said ball bearing's inner race.

11. An apparatus according to claim 1, wherein said attaching means comprises:

a second flange housing for connecting said dielectric waveguide to said waveguide system; and a second launching horn operably connected to said second flange housing, said second launching horn including:

a hollow copper cone flared concentrically about said dielectric waveguide; and a tubular extension of said copper cone for fixedly receiving and captivating said dielectric waveguide.

12. An apparatus according to claim 11 wherein said tubular extension of said first and second launching horns have opposed apertures in the walls thereof.

13. An apparatus according to claim 12 wherein said dielectric waveguide is captivated within said tubular extension at a point of optimum transmission, said dielectric waveguide having a transverse aperture cooperatively aligned with said opposed apertures of said extensions for receiving a means for captivating said dielectric waveguide, said captivating means comprising:

a dielectric stud, inserted through said tubular extension's apertures and said dielectric waveguides' apertures; and an epoxy binder attaching said stud to said tubular extensions.

14. An apparatus according to claim 12 wherein said dielectric waveguide has recesses therein which are aligned with said extension's apertures for captivation of said dielectric waveguide within said extension by the insertion of an epoxy binder through said apertures into said recesses, said captivation binding said dielectric waveguide within said extension at an optimum depth for transmission.

15. An apparatus according to claim 14 further comprising:

a first circumferentially corrugated section of circular waveguide affixed to said first flange housing, opposite said ball bearing; and a second circumferentially corrugated section of circular waveguide affixed to said second flange housing.

16. An apparatus according to claim 15 wherein said corrugated section is corrugated in such a manner and depth to form a predetermined hybrid mode, based on waveguide diameter and the wavelength desired.

* * * * *